US009520141B2

(12) United States Patent
Christensen et al.

(10) Patent No.: US 9,520,141 B2
(45) Date of Patent: Dec. 13, 2016

(54) KEYBOARD TYPING DETECTION AND SUPPRESSION

(71) Applicant: GOOGLE INC., Mountain View, CA (US)

(72) Inventors: Jens Enzo Nyby Christensen, Cambridge (GB); Simon J. Godsill, Cambridge (GB); Jan Skoglund, Mountain View, CA (US)

(73) Assignee: GOOGLE INC., Mountain View, CA (US)

( * ) Notice: Subject to any disclaimer, the term of this patent is extended or adjusted under 35 U.S.C. 154(b) by 247 days.

(21) Appl. No.: 13/781,262

(22) Filed: Feb. 28, 2013

(65) Prior Publication Data

US 2014/0244247 A1 Aug. 28, 2014

(51) Int. Cl.

| | |
|---|---|
| ***G10L 21/02*** | (2013.01) |
| ***G10L 25/48*** | (2013.01) |
| ***G10L 21/0216*** | (2013.01) |
| *G10L 25/84* | (2013.01) |

(Continued)

(52) U.S. Cl.

CPC ..... *G10L 25/48* (2013.01); *G10L 21/0216* (2013.01); *G10L 21/02* (2013.01); *G10L 21/0208* (2013.01); *G10L 25/84* (2013.01); *G10L 25/93* (2013.01); *G10L 2025/935* (2013.01)

(58) Field of Classification Search

CPC .. G10L 21/02; G10L 21/0202; G10L 21/0205; G10L 21/0216; G10L 2021/02082; G10L 2021/02085; G10L 2021/02087; G10L 2021/02161; G10L 2021/02163; G10L 2021/02165;G10L 2021/02166; G10L 2021/02168; G10L 21/0224; G10L 21/0232; G10L 21/026

See application file for complete search history.

(56) References Cited

U.S. PATENT DOCUMENTS

| | | | | |
|---|---|---|---|---|
| 5,012,519 A * | 4/1991 | Adlersberg et al. | ..... | 704/226 |
| 6,169,973 B1 * | 1/2001 | Tsutsui et al. | ..... | 704/500 |
| RE38,269 E * | 10/2003 | Liu | ..... | 704/227 |

(Continued)

FOREIGN PATENT DOCUMENTS

JP 2011-151481 A 8/2011

OTHER PUBLICATIONS

Torresani et al., "An hybrid audio scheme using hidden Markov Models of Waveforms", PDF version submitted to ACHA, Nov. 13, 2003, Applied and Computational Harmonic Analysis, vol. 18, Issue 2, Mar. 2005, pp. 137-166.*

(Continued)

*Primary Examiner* — Richard Zhu

(74) *Attorney, Agent, or Firm* — Birch, Stewart, Kolasch & Birch, LLP

(57) ABSTRACT

Provided are methods and systems for detecting the presence of a transient noise event in an audio stream using primarily or exclusively the incoming audio data. Such an approach offers improved temporal resolution and is computationally efficient. The methods and systems presented utilize some time-frequency representation of an audio signal as the basis in a predictive model in an attempt to find outlying transient noise events and interpret the true detection state as a Hidden Markov Model (HMM) to model temporal and frequency cohesion common amongst transient noise events.

20 Claims, 5 Drawing Sheets

(51) Int. Cl.
*G10L 25/93* (2013.01)
*G10L 21/0208* (2013.01)

(56) References Cited

U.S. PATENT DOCUMENTS

| | | | | |
|---|---|---|---|---|
| 7,353,169 | B1 | 4/2008 | Goodwin et al. | |
| 7,389,230 | B1 * | 6/2008 | Nelken | 704/255 |
| 7,664,643 | B2 * | 2/2010 | Gopinath | G10L 15/142 704/243 |
| 8,019,089 | B2 | 9/2011 | Seltzer et al. | |
| 8,121,311 | B2 * | 2/2012 | Hetherington | 381/93 |
| 8,213,635 | B2 | 7/2012 | Li et al. | |
| 8,239,194 | B1 * | 8/2012 | Paniconi | 704/226 |
| 8,265,292 | B2 | 9/2012 | Leichter | |
| 8,321,206 | B2 | 11/2012 | Goodwin et al. | |
| 8,411,874 | B2 | 4/2013 | Leichter | |
| 8,538,751 | B2 | 9/2013 | Nakadai et al. | |
| 9,111,526 | B2 * | 8/2015 | Visser | G10L 19/008 |
| 2004/0199382 | A1 * | 10/2004 | Bazzi et al. | 704/209 |
| 2004/0260548 | A1 * | 12/2004 | Attias et al. | 704/236 |
| 2005/0049866 | A1 * | 3/2005 | Deng et al. | 704/240 |
| 2008/0219466 | A1 * | 9/2008 | Pishehvar et al. | 381/73.1 |
| 2008/0279366 | A1 | 11/2008 | Lindbergh | |
| 2010/0088092 | A1 | 4/2010 | Bruhn | |
| 2011/0112831 | A1 | 5/2011 | Sorensen et al. | |
| 2011/0142257 | A1 | 6/2011 | Goodwin et al. | |
| 2011/0243123 | A1 | 10/2011 | Munoz-Bustamante et al. | |
| 2014/0114650 | A1 * | 4/2014 | Hershey | G10L 21/0232 704/203 |

OTHER PUBLICATIONS

Edgington et al., "Residual-Based Speech Modification Algorithms for Text-to-Speech Synthesis", 1996. ICSLP 96. Proceedings., Fourth International Conference on Spoken Language, published on Oct. 1996.*

Sethares et al., "Spectral Tools for Dynamic Tonality and Audio Morphing", Computer Music Journal 33(2), 2009.*

Cournapeau, "Hybrid representation for audio effects", published Sep. 2003.*

Takayuki et al., "Theoretical Analysis of Iterative Weak Spectral Subtraction via Higher-order statistics", 2010 IEEE International Workshop on Machine Learning for Signal Processing.*

He et al., "A solution to residual noise in speech denoising with sparse representation", 2012 IEEE conference on Acoustics, Speech and Signal Processing (ICASSP), Mar. 25-30, 2012.*

Chandra, C. et al., "An Efficient Method for the Removal of Impulse Noise From Speech and Audio Signals", IEEE International Symposium on Circuits and Systems,vol. 4, May 1998, pp. 206-208.

Fevotte C. et al., "Sparse Linear Regression in Unions of Bases via Bayesian Variable Selection", IEEE Signal Processing Letters, vol. 13, No. 7, Jul. 2006, pp. 441-444.

Fevotte C. et al., "Sparse Linear Regression With Structured Priors and Application to Denoising of Musical Audio", IEEE Transactions on Audio, Speech, and Language Processing, vol. 16, No. 1, Jan. 2008, pp. 174-185.

Godsill, S. J. et al., "Statistical Reconstruction and Analysis of Autoregressive Signals in Impulsive Noise Using the Gibbs Sampler", IEEE Transactions on Speech and Audio Processing, vol. 6, No. 4, Jul. 1998, pp. 352-372.

Murphy et al., "Joint Bayesian Removal of Impulse and Background Noise", IEEE International Conference on Acoustics, Speech and Signal Processing (ICASSP), May 2011, pp. 261-264.

Nongpiur, R.C., "Impulse Noise Removal in Speech Using Wavelets", IEEE International Conference on Acoustics, Speech and Signal Processing (ICASSP), Mar. 2008, pp. 1593-1596.

Subramanya, A. et al. "Automatic Removal of Typed Keystrokes from Speech Signals", Interspeech, 2006, pp. 261-264.

Sugiyama, A., "Single-Channel Impact-Noise Suppression With No Auxiliary Information for Its Detection", IEEE Workshop on Applications of Signal Processing to Audio and Acoustics, Oct. 21-24, 2007, pp. 127-130.

Vaseghi, S. V., "Detection and suppression of impulsive noise in speech communication systems", IEEE Proceedings, vol. 137, Pt. 1, No. 1, Feb. 1990.

Wolfe, P.J. et al., "Bayesian Estimation of Time-Frequency Coefficients for Audio Signal Enhancement", in Advances in Neural Information Processing Systems, The MIT Press, 2003. Cambridge, MA.

Wolfe, P.J. et al., "Bayesian variable selection and regularization for time-frequency estimation", J.R. Statist. Soc. B, (2004), vol. 66, Part 3, pp. 575-589.

Daudet L. et al., "Hybrid representations for audiophonic signal encoding", Signal Processing, Elsevier Science Publishers B.V. Amsterdam, vol. 82, No. 11., Nov. 1, 2002, pp. 1595-1617.

Molla S. et al., "Hidden Markov Tree Based Transient Estimation for Audio Coding", Proceedings, 2002 IEEE International Conference on MultiMedia and Expo, vol. 1, Aug. 26, 2002, pp. 489-492.

Korean Office Action, dated Jun. 17, 2016, in related application No. KR2016-043874975.

Office Action issued in the corresponding Japanese Patent Application No. 2015-557216, issued on Sep. 20, 2016, along with an English translations thereof.

* cited by examiner

KEYBOARD TYPING DETECTION AND SUPPRESSION

TECHNICAL FIELD

The present disclosure generally relates to methods, systems, and apparatus for signal processing. More specifically, aspects of the present disclosure relate to detecting transient noise events in an audio stream using the incoming audio data.

BACKGROUND

The ubiquitous nature of high speed internet connections has made personal computers a popular basis for teleconferencing applications. While embedded microphones, loudspeakers, and webcams in laptop computers have made conference calls very easy to set up, these features have also introduced specific noise nuisances such as feedback, fan noise, and button-clicking noise. Button-clicking noise has been a particularly persistent problem, and is generally due to the mechanical impulses caused by keystrokes. In the context of laptop computers, button-clicking noise can be a significant nuisance due to the mechanical connection between the microphone within the laptop case and the keyboard.

The noise pulses produced by keystrokes can vary greatly with factors such as keystroke speed and length, microphone placement and response, laptop frame or base, keyboard or trackpad type, and even the surface on which the computer is placed. It is also noted that in many scenarios the microphone and the noise source might not even be mechanically linked, and in some cases the keyboard strokes could originate from an entirely different device, making any attempt at incorporating software cues futile.

There are a handful of approaches that attempt to address the problem described above. However, none of these proposed solutions attempt to tackle the issue in real-time, and none are based purely on the audio stream. For example, a first approach utilizes a linear predictive model on frequency bins in an area around the audio frame in question. While this first approach has the advantage of dealing with speech segments with sharp attacks, the required look-ahead is between 20-30 milliseconds (ms), which will delay any detection by at least this much. Such an approach has been suggested only as an aid where the final detection decision requires confirmation from the hardware keyboard.

It should be noted that with frame lengths of 20 ms and overlaps of 10 ms, the exact localization of the transient is lost. Exact localization of the transient is of interest when the transient is to be removed from the audio stream. It is also worth noting that many transient noises might not be detectable as a hardware input through the keyboard and a more general approach will provide a more consistent noise reduction performance on transient noise.

A second approach proposes relying on a median filter to identify outlying noise events and then restoring audio based on the median filter data. This second approach is primarily designed for much faster corruption events with only a few corrupted samples.

A third approach is similar to the second approach described above, but with wavelets used as the basis. While this third approach increases the temporal resolution of detection, the approach considers the scales independently, which might give rise to false detections based on the more transient voiced speech components.

A fourth approach to resolving the nuisance of button-clicking noise proposes an algorithm relying on no auxiliary data. In this fourth approach, detection is based on the Short Time Fourier Transform and detections are identified by spectral flatness and increasing rate of high-frequency components, which can falsely detect voiced segments with a sudden onset. The algorithm proposed in this fourth approach is meant for post-processing, and a computationally-efficient real-time implementation of this algorithm would lose temporal resolution. It is also not clear that this fourth approach would work well for the range of transient noise seen in real life applications. A probabilistic interpretation of the detection state could yield a more adaptable and dependable basis for detection. This fourth approach also proposes restoration based on scaled frequency components which, coupled with the low temporal resolution, could be overly invasive and unsettling to the listener.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

One embodiment of the present disclosure relates to a method for detecting presence of a transient noise in an audio signal, the method comprising: identifying one or more voiced parts of the audio signal; extracting the one or more identified voiced parts from the audio signal, wherein the extraction of the one or more voiced parts yields a residual part of the audio signal; estimating an initial probability of one or more detection states for the residual part of the signal; calculating a transition probability between each of the one or more detection states; and determining a probable detection state for the residual part of the signal based on the initial probabilities of the one or more detection states and the transition probabilities between the one or more detection states.

In another embodiment, the method for detecting presence of a transient noise further comprises preprocessing the audio signal by recursively subtracting tonal components.

In another embodiment of the method for detecting presence of a transient noise, the step of preprocessing the audio signal includes decomposing the audio signal into a set of coefficients.

In another embodiment, the method for detecting presence of a transient noise further comprises performing a time-frequency analysis on the residual part of the audio signal to generate a predictive model of the residual part of the audio signal.

In another embodiment, the method for detecting presence of a transient noise further comprises recombining the residual part of the audio signal with the one or more extracted voiced parts.

In another embodiment, the method for detecting presence of a transient noise further comprises determining, based on the residual part of the audio signal, that additional voiced parts remain in the residual part of the audio signal, and extracting one or more of the additional voiced parts from the residual part of the audio signal.

In yet another embodiment, the method for detecting presence of a transient noise further comprises, prior to recombining the residual part and the one or more extracted voiced parts, determining that the one or more extracted voiced parts include low-frequency components of the transient noise, and filtering out the low-frequency components of the transient noise from the one or more extracted voiced parts.

In still another embodiment, the method for detecting presence of a transient noise further comprises modeling additive noise in the residual part of the signal as a zero-mean Gaussian process.

In another embodiment, the method for detecting presence of a transient noise further comprises modeling additive noise in the residual part of the signal as an autoregressive (AR) process with estimated coefficients.

In yet another embodiment, the method for detecting presence of a transient noise further comprises identifying corrupted samples of the audio signal based on the estimated detection state, and restoring the corrupted samples in the audio signal;

In another embodiment of the method for detecting presence of a transient noise, the step of restoring the corrupted samples includes removing the corrupted samples from the audio signal.

In one or more other embodiments, the methods presented herein may optionally include one or more of the following additional features: the time-frequency analysis is a discrete wavelet transform; the time-frequency analysis is a wavelet packet transform; the one or more voiced parts of the audio signal are identified by detecting spectral peaks in the frequency domain; the spectral peaks are detected by thresholding a median filter output, and/or the one or more additional voiced parts are identified by detecting spectral peaks in the frequency domain for the residual part of the audio signal.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
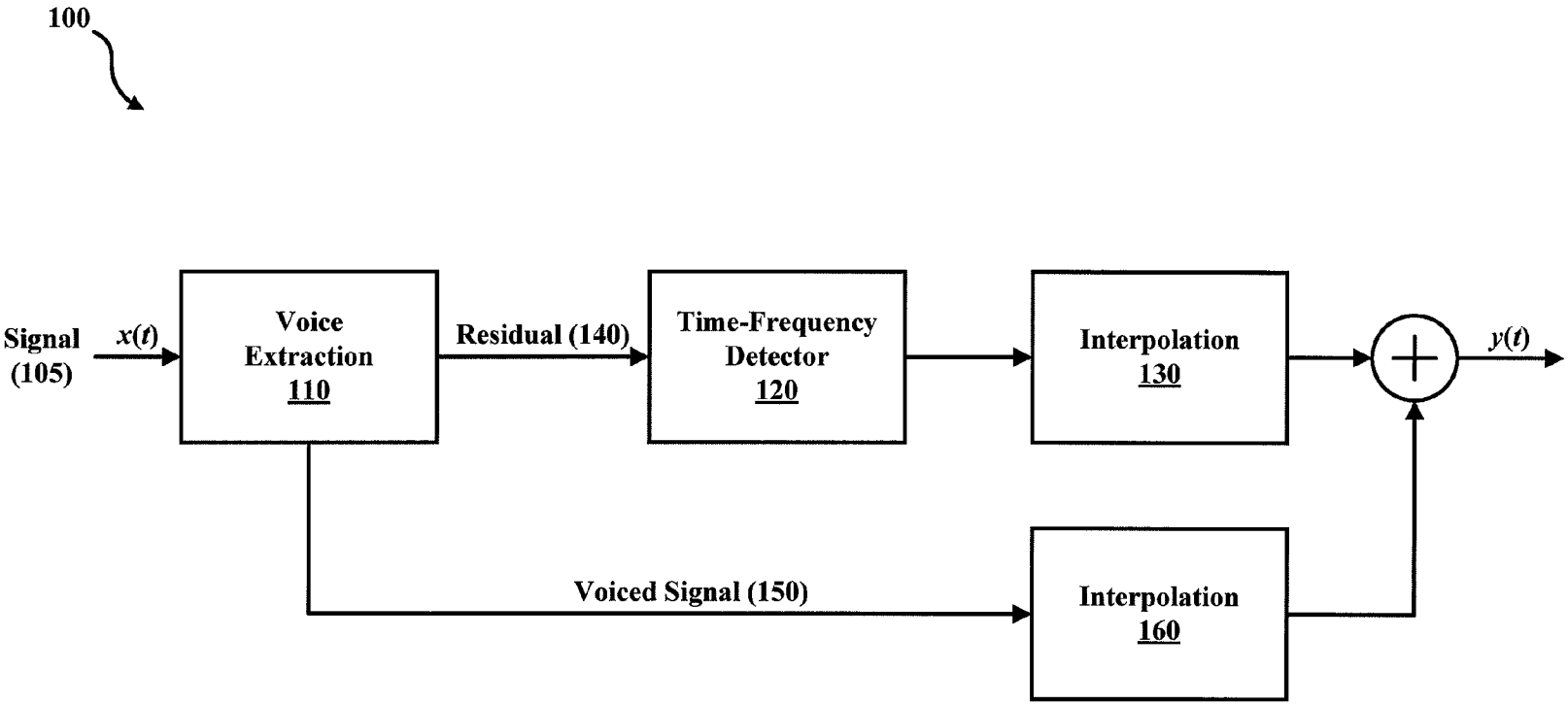
FIG. 1 is a block diagram illustrating an example system for detecting the presence of a transient noise event in an audio stream using the incoming audio data according to one or more embodiments described herein.

The headings provided herein are for convenience only and do not necessarily affect the scope or meaning of what is claimed in the present disclosure.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments will now be described. The following description provides specific details for a thorough understanding and enabling description of these examples. One skilled in the relevant art will understand, however, that one or more embodiments described herein may be practiced without many of these details. Likewise, one skilled in the relevant art will also understand that one or more embodiments of the present disclosure can include many other obvious features not described in detail herein. Additionally, some well-known structures or functions may not be shown or described in detail below, so as to avoid unnecessarily obscuring the relevant description.

1. Overview

Embodiments of the present disclosure relate to methods and systems for detecting the presence of a transient noise event in an audio stream using primarily or exclusively the incoming audio data. Such an approach provides improved temporal resolution and is computationally efficient. As will be described in greater detail below, the methods and systems presented herein utilize some time-frequency representation (e.g., discrete wavelet transform (DWT), wavelet packet transform (WPT), etc.) of an audio signal as the basis in a predictive model in an attempt to find outlying transient noise events. Furthermore, the methods of the present disclosure interpret the true detection state as a Hidden Markov Model (HMM) to model temporal and frequency cohesion common amongst transient noise events.

As will be further described herein, the algorithm proposed uses a preprocessing stage to decompose an audio signal into a sparse set of coefficients relating to the noise pulses. To minimize false detections, the audio data may be preprocessed by subtracting tonal components recursively, as system resources allow. While this approach detects and restores transient noise events primarily based on a single audio stream, various parameters can be tuned if positive detections can be confirmed via operating system (OS) information or otherwise.

The algorithm presented below exploits the contrast in spectral and temporal characteristics seen between transient noise pulses and speech signals. While switched noise processes are used in a handful of offline applications for detection of noise pulses, some with a sparse basis, these other approaches are batch processing implementations, none of which are suitable for real-time implementation. Additionally, the processing requirements of these existing approaches are not trivial, and thus they cannot feasibly be implemented as part of a real-time communication system.

Other systems have utilized Markov Chain Monte Carlo (MCMC) methods for modeling temporal and spectral cohesion in two-state detection systems. However, these systems are also considered batch processing implementations with significant computational requirements. Although the Bayesian restoration step proposed in one or more embodiments of the present disclosure has similarities to other restoration approaches, the Gaussian impulse and background model utilized in the present disclosure dramatically simplifies the restoration to a computationally-efficient implementation, as will be further described herein.

2. Detection

FIG. 1 illustrates an example system for detecting the presence of a transient noise event in an audio stream using the incoming audio data according to one or more embodiments described herein. In at least one embodiment, the detection system 100 may include a voice extraction component 110, a time-frequency detector 120, and interpolation components 130 and 160 for the residual and voiced signals, respectively. Additionally, the detection system 100 may perform an algorithm similar to the algorithm illustrated in FIG. 3, which is described in greater detail below.

An audio signal 105 input into the detection system 100 may undergo voice extraction 110, resulting in a voiced signal part 150 and a residual signal part 140. Following voice extraction 110, the residual signal part 140 may undergo time-frequency analysis (via the time-frequency detector 120) providing information for the possible restoration step (via the interpolation component 130). The voiced signal 150 may require restoration based on the time-frequency detector 120 findings, which may be performed by the interpolation component 160 for the voiced signal 150. The interpolated voice signal 150 and residual signal 140 may then be recombined to form the output signal. Each of the voice extraction 110, the time-frequency detector 120, and the interpolations 130, 160 will be described in greater detail in the sections that follow.

It should be noted that, in accordance with at least one embodiment described herein, the detection system 100 may perform the detection algorithm in an iterative manner. For example, once the interpolated voice signal 150 and residual signal 140 are recombined following any necessary restoration processing (e.g., by interpolation components 130 and 160), a determination may be made as to whether further restoration of the signal is needed. If it is found that further restoration is needed, then the recombined signal may be processed again through the various components of the detection system 100. Having removed some of the transient components from the signal during the initial iteration, a subsequent iteration may affect the audio separation and lead to better overall results.

Figure 2:
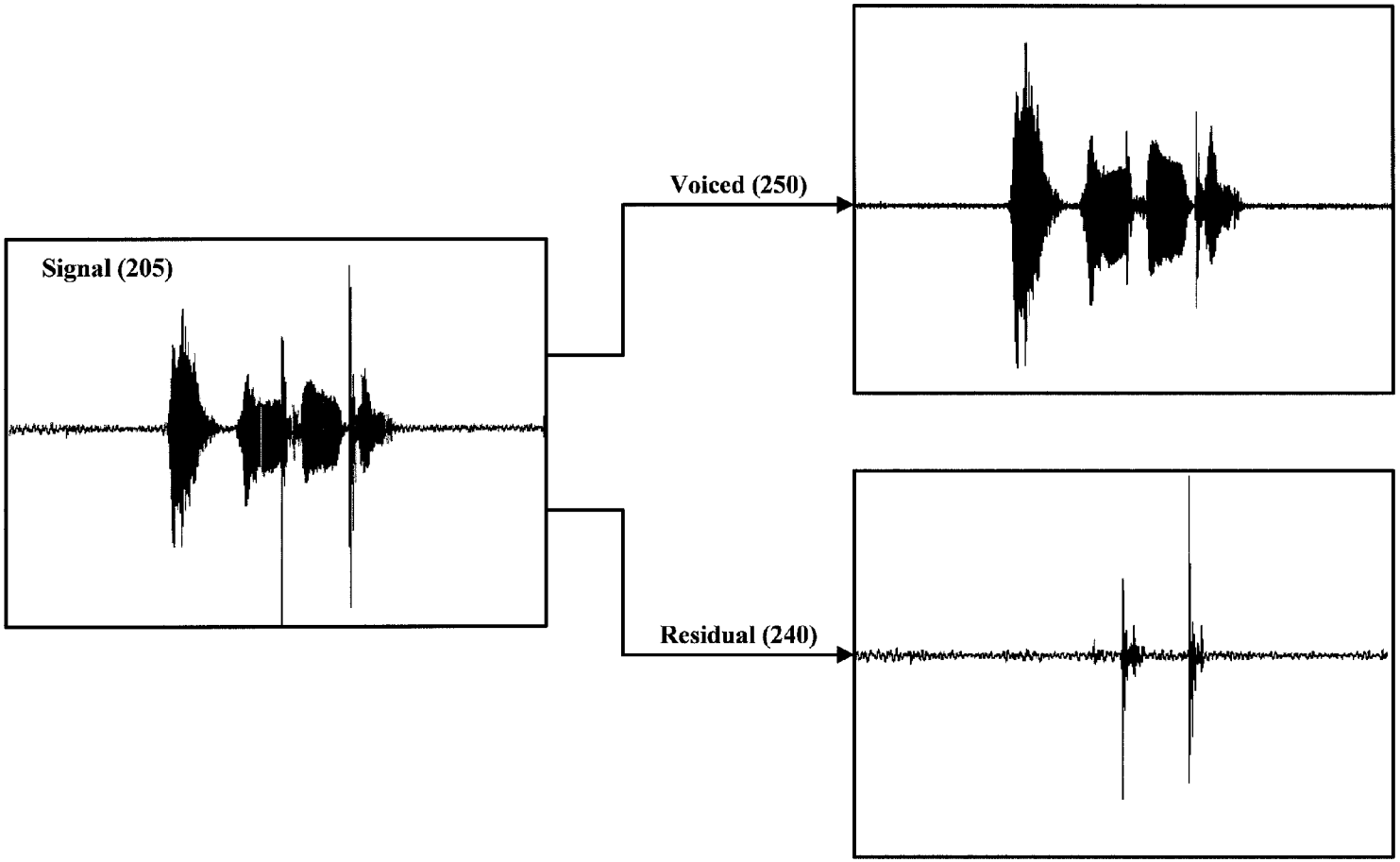
FIG. 2 is a graphical representation illustrating an example output of voiced signal extraction according to one or more embodiments described herein.

FIG. 2 illustrates an example output of voiced signal extraction according to one or more embodiments described herein. For example, the output of voice extraction on an input signal 205 (e.g., by the voice extraction component 110 on the input signal 105 in the example system shown in FIG. 1) may include a voiced signal part 250 and a residual signal part 240, (e.g., the voiced signal part 150 and the residual signal part 140 in the example system shown in FIG. 1).

Figure 3:
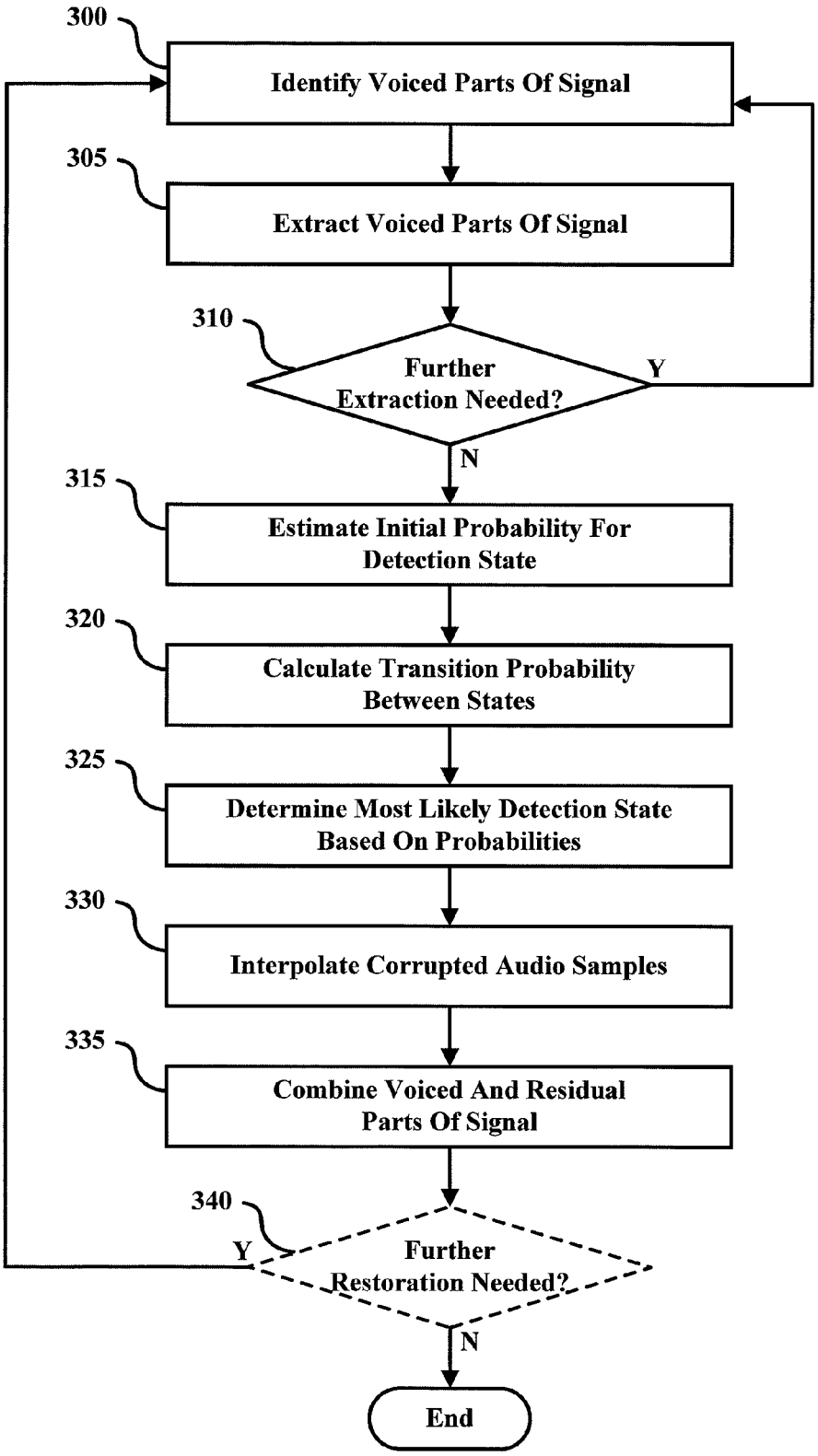
FIG. 3 is a flowchart illustrating an example method for detecting the presence of a transient noise event in an audio stream using the incoming audio data according to one or more embodiments described herein.

In the following sections reference may be made to FIG. 3, which illustrates an example process for detecting the presence of a transient noise event in an audio stream using the incoming audio data. In at least one embodiment, the process illustrated may be performed, for example, by the voice extraction component 110, the time-frequency detector 120, and the interpolation components 130, 160 of the detection system 100 shown in FIG. 1 and described above.

2.1 Tonal Extractor

To reduce the rate of false detections, voiced parts of the signal can be extracted (e.g., via the voice extraction 110 of the example detection system shown in FIG. 1). The voiced parts of the signal may be identified and then extracted at blocks 300 and 305, respectively, of the process illustrated in FIG. 3. For example, the voiced parts of the signal may be identified by detecting acoustic resonances, or spectral peaks, in a frequency domain. The voiced parts may then be extracted prior to the detection procedure. Peaks in the spectral domain can be identified, for example, by thresholding a median filter output or by some other peak-detection method.

At block 310, a determination may be made as to whether further extraction (e.g., voice extraction) is needed. If further extraction is needed, then the process may return to blocks 300 and 305. By repeating the identification and extraction (e.g., at blocks 300 and 305) multiple times for different frame sizes and thresholds, additional voiced parts of the signal may be extracted. If no further extraction is needed at block 310, the process may move to estimating the initial probability for the detection state (block 315), calculating the transition probability between states (block 320), determining the most likely detection state based on the probabilities of each state (block 325), and interpolating the corrupted audio samples (block 330). The operations shown in blocks 315 through 330 will be described in greater detail below.

In at least one embodiment, after the detection state has been estimated the process may move to block 335 where the voiced parts of the signal may be reintroduced (e.g., following voice extraction 110, time-frequency analysis 120, and interpolation 130, the residual signal part 140 may be recombined with the extracted voiced signal part 150 (e.g., following interpolation 160) as illustrated in FIG. 1).

The audio signal can now be expressed in the following way:

$$x(t) = \sum_i c_i \Phi_i(t) + \sum_j w_j(t) \Psi_j(t) \tag{1}$$

where $c_i$ are the coefficients for the voiced parts of the signal and $\Phi$ is a basis function which could be based on standard Fourier, Cepstrum or Gabor analysis, or Voice Speech filters. Also, $w_j(t)$ are the coefficients of the residual part, where j is an integer relating to some translation and/or dilation of some basis function $\Psi$.

2.2 Time-Frequency Analysis of the Residual

The coefficients $w_j(t)$ from equation (1), above, may be interpreted as wavelet coefficients from a Wavelet Packet Decomposition (WPD) such that j denotes the jth terminal node or scale, $j \in \{1, \ldots, J\}$, where $J=L^2$ for a level L decomposition. In the following description, n will replace t as the time index in the wavelet coefficients due to the scaling caused by decimation, but for the case of an undecimated transform t=n. Further, w(n) will be used to denote a vector of all coefficients at a given time index n. It may be assumed that the coefficients for each terminal node j can be modeled as some switched additive noise process such that:

$$w_j(n) = i_{n,j}\theta_{n,j} + v_{n,j}, \tag{2}$$

where $i_{n,j}$ is the binary (1/0) switching variable denoting the presence of $\theta_{n,j}$ for $i_{n,j}=1$, and otherwise $i_{n,j}=0$. The transient signal $\theta_{n,j}$ is thus a switched noise burst corrupted by additive noise $v_{n,j}$. It should be noted that the grouping of the transient noise bursts may depend on the statistics of $i_{n,j}$. Corresponding values of $i_{n,j}$ at different scales j and with consecutive time indexes n may be modeled as a Markov chain, which will describe some degree of cohesion between frequency and time. For example, the transient noise pulses will typically have a similar index of onset and will likely stay active for a length of time proportional with wavelet scale j.

The model may now be expressed in terms of the additive noise and a matrix of coefficients:

$$w=\theta+v, \tag{3}$$

where $w=[w_1, w_2, \ldots, w_j]$ and where $w_j=[w_{1,j}, w_{2,j}, \ldots, w_{N,j}]^T$ for the jth set of coefficients. Also in equation (3), θ denotes the corresponding switched noise burst J by N matrix containing elements $i_{n,j}\theta_{n,j}$ and v is the random additive noise describing, for example, the effect of speech on the coefficients. For simplicity, $i_{n,j}$ may be considered constant across scales j so the discrete vector $i=[i_1, i_2, \ldots, i_N]$ can take any one of $2^N$ values. Accordingly, the detection task now becomes the estimation of the true state of i from the observed sequence w. In more sophisticated realizations, the i values across different scales may differ from one another, and would be statistically linked together via a hidden Markov tree or similar construction.

Assuming that both the noise burst θ and the background noise (e.g., speech) v can be modeled as zero mean Gaussian distributions gives the following:

$$\theta_n \sim N_{\theta_n}(0,\Lambda), \tag{4}$$

where Λ is a covariance matrix. In one example, the diagonal elements of Λ may simply be $[\lambda_1, \lambda_2, \ldots, \lambda_J]$. However, in another example, the diagonal elements of Λ could also represent more complex variance cohesion. Rather than keeping the variance constant for the duration of the noise pulse, a changing variance model based on some envelope of the changing variance may provide a more accurate match for transients of interest.

The background noise may similarly be modeled as a zero-mean Gaussian process, such that:

$$v_n \sim N_{v_n}(0,C_v) \tag{5}$$

where $C_v$ is a covariance matrix. In one example, the diagonal components of $C_v$ may simply be $[\sigma_{v,1}, \sigma_{v,2}, \ldots, \sigma_{v,J}]$. A more computationally-intensive implementation could model v as an autoregressive (AR) process with estimated coefficients or with a simple averaging coefficient set.

A straightforward implementation based on AR background noise may assume that each coefficient can be estimated by the M preceding (and possibly succeeding) coefficients in addition to some noise. Treating each scale as independent, the combined likelihood may be calculated by the product of the likelihood from each scale. In such an implementation, transient noise events could be detected by thresholding the combined likelihood. Additional algorithmic details of such an implementation are provided below in "Example Implementation."

Treating the detection state i as a discrete random vector, the probability of i conditional upon the observed (and corrupted) data w and other prior information available may be determined. Prior information regarding detections may include, for example, information from the operation system (OS), inferred likely detection timings based on recent detection, inferred likely detection timings based on learned information from the user, and the like. In accordance with at least one embodiment, this posterior probability p(i|w) may be expressed using Bayes' rule so that $$p(i \mid w) = \frac{p(w \mid i)p(i)}{p(w)}, \tag{6}$$

where the likelihood p(w|i) may be considered the primary part of the calculation.

As described above, θ denotes the switched random noise process. The amplitude of this switched random noise process may be defined by the noise burst amplitude p.d.f. $p_\theta$, which is the joint distribution for the burst amplitudes where $i_n=1$.

Since both functions $p_v(v)$ and $p_\theta(\theta)$ are zero-mean Gaussians, each set of wavelet coefficients may be expressed as $w_j(n)$, such as the following:

$$w_j(n) \sim \begin{cases} N(0, \sigma_{v,j} + \lambda_j); & i_n = 1 \\ N(0, \sigma_{v,j}); & i_n = 0, \end{cases} \tag{7}$$

and the likelihood function p(w|i) becomes $$p(w \mid i) = \prod^{J} \prod^{N} N(0, \sigma_{v,j} + i_n\lambda_j). \tag{8}$$

The Maximum a posteriori (MAP) estimate for $i_n$ may now be calculated as $$\hat{i}_n^{MLE} = \arg\max_{i\in\{0,1\}} \prod^{J} N(0, \sigma_{v,j} + i_n\lambda_j). \tag{9}$$

In accordance with one or more embodiments of the disclosure, the knowledge that detections usually come in blocks of detections may be incorporated into the model. For example, considering the state vector i as a HMM, specific knowledge about the nature of expected detections may be incorporated into the model. In at least one embodiment, the Viterbi algorithm may be used to calculate the most likely evolution of i or sequence of $i_n$. The most likely detection state given a sequence of data may be expressed as:

$$\hat{i}^{MLE} = \arg\max_{i\in\{0,1\}} p(i_0) \prod_n p(i_n \mid i_{n-1}) p(w(n) \mid i_n). \tag{10}$$

In equation (10), $p(i_0)$ is the starting probability, $p(i_n|i_{n-1})$ is the transition probability from one state to the next, and $p(w(n)|i_n)$ is the emission probability or the observation probability.

In accordance with at least one embodiment of the disclosure, an extension to the algorithm described above and illustrated in FIG. 3 may include running the entire algorithm in an iterative manner. For example, the process may move from block 335, where the voiced parts of the signal may be reintroduced and combined with the residual signal part (e.g., following voice extraction 110, time-frequency analysis 120, and interpolation 130, the residual signal part 140 may be recombined with the extracted voiced signal part 150, as illustrated in FIG. 1), to block 340 where it is determined whether further restoration of the signal is needed (represented by broken lines in FIG. 3). If it is determined at block 340 that further restoration is needed, the process may return to block 300 and repeat. Having removed some of the transient components from the signal during the previous iteration, this next iteration may affect the audio separation and lead to better overall results. If it is determined at block 340 that no further restoration is needed, the process may end.

Figure 4:
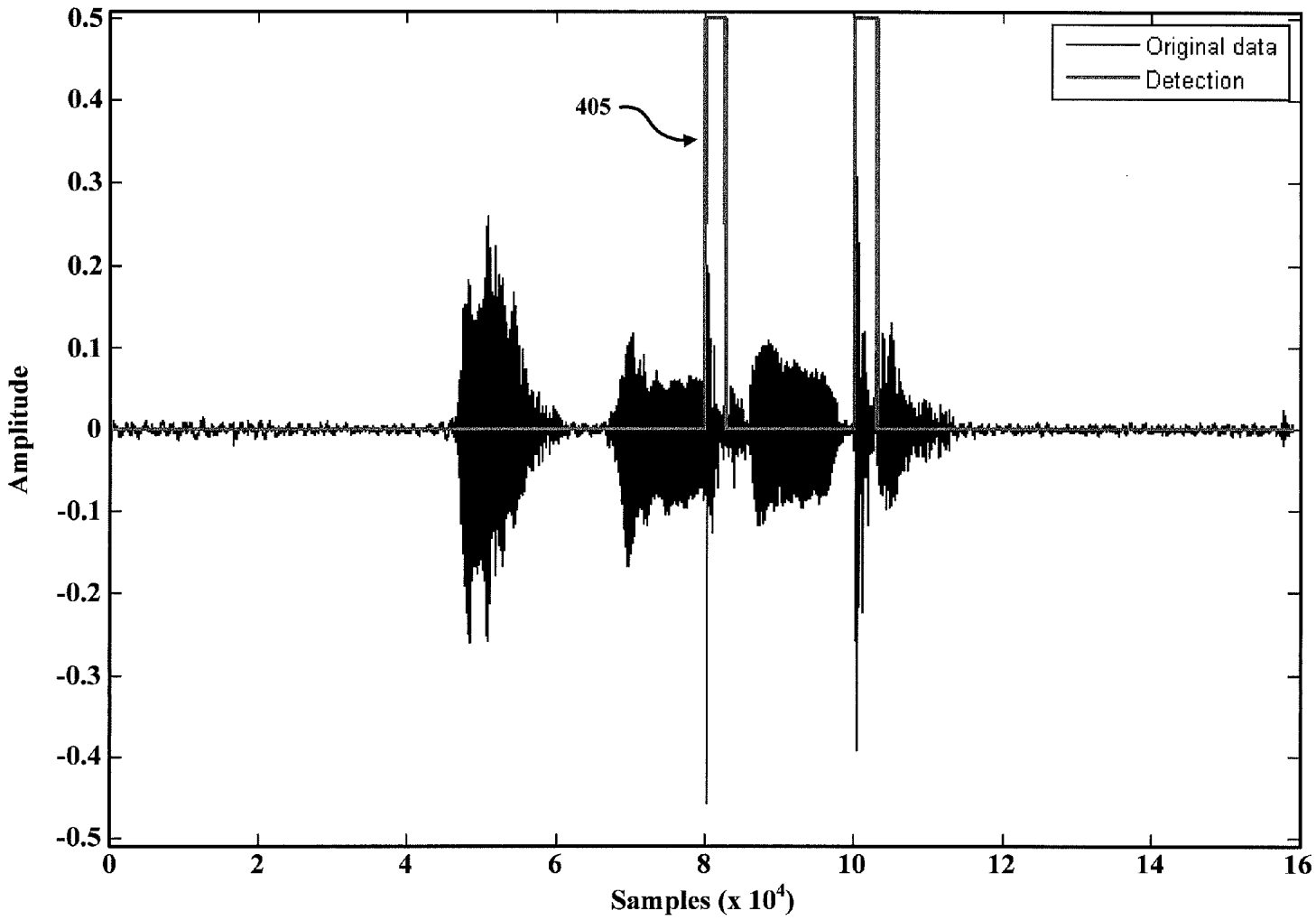
FIG. 4 is a graphical representation illustrating an example performance of transient noise detection according to one or more embodiments described herein.

FIG. 4 illustrates an example performance of transient noise detection in accordance with one or more of the embodiments described herein. In the example graphical representation, where the step function 405 indicates detections, a detection is found at the high value and no detection at the low value. The detections 405 are also an indication of possible areas for interpolation with components 130 and 160 as illustrated in FIG. 1.

In the example case shown in FIG. 4, the detected state agrees with the ground truth for the example and the transients are picked up despite the surrounding voiced signal. The step function 405 indicates a range of corrupted samples and not just a single detection at each transient noise event. This is because the algorithm, in this case, correctly determines an appropriate number of corrupted samples. The benefit of using a decomposition with good temporal resolution is that the detection onset and duration can be more accurately determined and corrupted frames can be dealt with in a less intrusive manner.

3. Interpolation

Having estimated the most likely state of i, as described in the previous sections above, it is now possible to interpolate corrupted samples (e.g., values of w(n) at time n for which $i_n=1$) using one or more of a variety of methods.

In at least one embodiment, a Bayesian approach may proceed by estimating $p(v_n|w_n,i_n)$. For example, using Bayes' rule gives the following:

$$p(v_n|w_n,i_n)\propto p(w_n|v_n,i_n)p(v_n|i_n), \tag{11}$$

where $$p(w_n|v_n,i_n=1)\sim N(w_n,\Lambda), \tag{12}$$

and $$p(v_n|i_n)=p(v_n)\sim N(0,C_v). \tag{13}$$

Substituting equations (12) and (13) into equation (11) where the product is proportional to a third Gaussian gives the following:

$$p(v_n|w_n,i_n=1)\propto N((C_v+\Lambda)^{-1}C_v w_n,(C_v^{-1}+\Lambda^{-1})^{-1}). \tag{14}$$

In this case, where both the background noise $v_n$ and the noise burst $\theta_n$ are Gaussian, estimating the mean of the conditional distribution equates to simply scaling corrupted samples by a factor of $(C_v+\Lambda)^{-1}C_v$ in a Wiener-style wavelet shrinkage. The simple form of such estimation should be noted in the above case with diagonal covariance matrices.

In one or more other embodiments, a more straightforward restoration approach may entirely remove the offending coefficients while a more complex approach may attempt to fill-in the corrupted coefficients with an AR process trained on preceding and succeeding coefficients.

In accordance with at least one embodiment of the disclosure, having estimated the most likely state of $i_n$, it may further be necessary to filter out any low-frequency (e.g., below a predetermined threshold frequency) components of the transient noise that were removed/extracted with the voiced speech (e.g., voiced signal part 150 as shown in FIG. 1).

Following the restoration process, the algorithm may proceed by recombining the processed residual signal part (e.g., with the keystrokes removed) and the dictionary of tonal components from equation (1).

4. Example Implementation

The following describes an example implementation for detecting transient noise events in accordance with at least one embodiment of the present disclosure. It should be noted that this example implementation is of a simplified embodiment that has had the Bayesian/HMM components removed and replaced with a traditional AR model-based detector for the transient noise. As such, the following is provided merely for purposes of illustration, and is not in any way intended to limit the scope of the present disclosure.

The present example is based on AR background noise and assumes that each coefficient can be estimated by the M preceding (and possibly succeeding) coefficients in addition to some noise (where "M" is an arbitrary number). Treating each scale as independent, the combined likelihood may be calculated by the product of the likelihood from each scale. In such an implementation, transient noise events could be detected by thresholding the combined likelihood. Additional algorithmic details of such an implementation are provided below.

The terminal node coefficients of a WPD, or some other time-frequency analysis coefficients, of an incoming audio sequence x(n) of length N may be defined as X(j,t), where j is the jth terminal node (scale or frequency), $j\in\{1,\ldots,J\}$, and t is the time index related to n. A level L WPD gives $J=2^L$ terminal nodes. In the following, X(t) may be used to denote a vector of all coefficients at a given time index t. Additionally, it may be assumed that the coefficients for each terminal node j follow the linear predictive model $$X(j,t)=\sum_{m=1}^{m}a_{j,m}X(j,t-m)+v(j,t), \tag{15}$$

where $a_{jm}$ is the mth weight applied to the jth terminal node so that $a_j=\{a_{j,1},\ldots,a_{j,M}\}$, M is the size of the buffer used, and v(j,t) is Gaussian noise with zero mean so that $$v(j,t)\sim N_v(0,\sigma_{j,t}^2). \tag{16}$$

The probability of X(j,t) conditional on prior values of X may now be expressed as $$p(X(j,t)\,|\,X(j,t-1),\ldots,X(j,t-M))=N_X\left(\sum_{m=1}^{M}a_{j,m}X(j,t-m),\sigma_{j,t}^2\right), \tag{17}$$

and the marginal probability may be expressed as $$p(X(t))=\prod^{J}p(X(j,t)), \tag{18}$$

assuming that the conditional probabilities for each set of coefficients are independent.

The log-likelihood log L=log p(X(t)) for the current coefficient X(t) may be calculated as $$\log L=\log\left\{\prod^{J}p(X(j,t)\,|\,X(j,t-1),\ldots,X(j,t-M))\right\} \tag{19}$$

-continued $$= \sum^{J} \log L$$

$$= \log\{p(X(j,t) \mid X(j,t-1), \ldots, X(j,t-M))\}$$

$$= -\frac{1}{2}\sum^{J} \frac{1}{\sigma_{j,t}^2}\left(X(j,t) - \sum_{m=1}^{M} a_{j,m} X(j,t-m)\right)^2 + C_{j,t},$$

where $C_{j,t}$ is a constant. The value log L is now a measure of how well X(t) can be predicted by its previous values.

Figure 5:
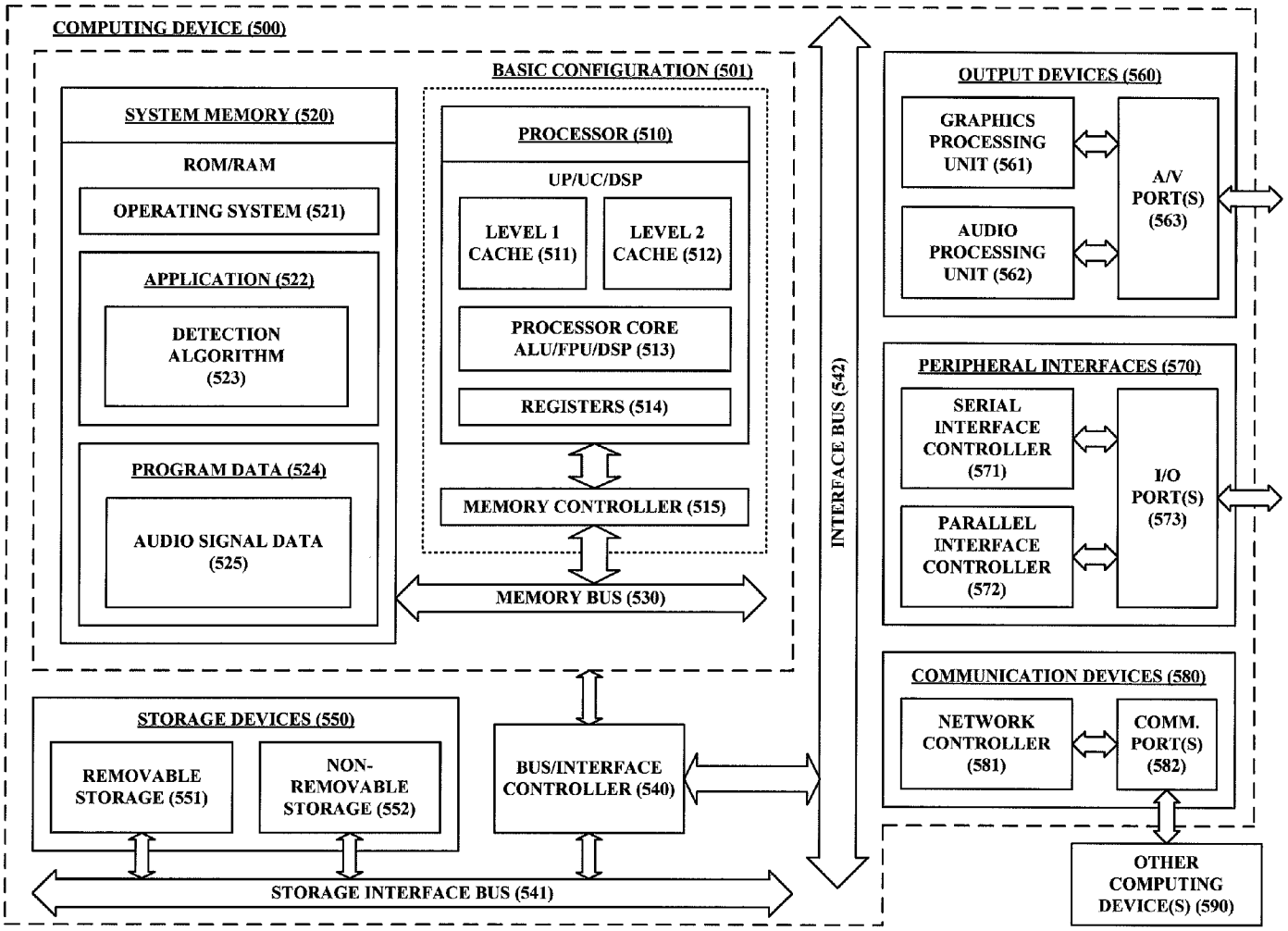
FIG. 5 is a block diagram illustrating an example computing device arranged for detecting the presence of a transient noise event in an audio stream using the incoming audio data according to one or more embodiments described herein.

FIG. 5 is a block diagram illustrating an example computing device 500 that is arranged for detecting the presence of a transient noise event in an audio stream using the incoming audio data in accordance with one or more embodiments of the present disclosure. For example, computing device 500 may be configured to utilize a time-frequency representation of an incoming audio signal as the basis in a predictive model in an attempt to find outlying transient noise events, as described above. In accordance with at least one embodiment, the computing device 500 may further be configured to interpret the true detection state as a Hidden Markov Model (HMM) to model temporal and frequency cohesion common amongst transient noise events. In a very basic configuration 501, computing device 500 typically includes one or more processors 510 and system memory 520. A memory bus 530 may be used for communicating between the processor 510 and the system memory 520.

Depending on the desired configuration, processor 510 can be of any type including but not limited to a microprocessor (μP), a microcontroller (μC), a digital signal processor (DSP), or any combination thereof. Processor 510 may include one or more levels of caching, such as a level one cache 511 and a level two cache 512, a processor core 513, and registers 514. The processor core 513 may include an arithmetic logic unit (ALU), a floating point unit (FPU), a digital signal processing core (DSP Core), or any combination thereof. A memory controller 515 can also be used with the processor 510, or in some embodiments the memory controller 515 can be an internal part of the processor 510.

Depending on the desired configuration, the system memory 520 can be of any type including but not limited to volatile memory (e.g., RAM), non-volatile memory (e.g., ROM, flash memory, etc.) or any combination thereof. System memory 520 typically includes an operating system 521, one or more applications 522, and program data 524. In one or more embodiments, application 522 may include a detection algorithm 523 that is configured to detect the presence of a transient noise event in an audio stream (e.g., input signal 105 as shown in the example system of FIG. 1) using primarily or exclusively the incoming audio data. For example, in one or more embodiments the detection algorithm 523 may be configured to perform preprocessing on an incoming audio signal to decompose the signal into a sparse set of coefficients relating to the noise pulses and then perform time-frequency analysis on the decomposed signal to determine a likely detection state. As part of the preprocessing, the detection algorithm 523 may be further configured to perform voice extraction on the input audio signal to extract the voiced signal parts (e.g., via the voice extraction component 110 of the example detection system shown in FIG. 1).

Program Data 524 may include audio signal data 525 that is useful for detecting the presence of transient noise in an incoming audio stream. In some embodiments, application 522 can be arranged to operate with program data 524 on an operating system 521 such that the detection algorithm 523 uses the audio signal data 525 to perform voice extraction, time-frequency analysis, and interpolation (e.g., voice extraction 110, time-frequency detector 120, and interpolation 130 in the example detection system 100 shown in FIG. 1).

Computing device 500 can have additional features and/or functionality, and additional interfaces to facilitate communications between the basic configuration 501 and any required devices and interfaces. For example, a bus/interface controller 540 can be used to facilitate communications between the basic configuration 501 and one or more data storage devices 550 via a storage interface bus 541. The data storage devices 550 can be removable storage devices 551, non-removable storage devices 552, or any combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), tape drives and the like. Example computer storage media can include volatile and nonvolatile, removable and non-removable media implemented in any method or technology for storage of information, such as computer readable instructions, data structures, program modules, and/or other data.

System memory 520, removable storage 551 and non-removable storage 552 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 500. Any such computer storage media can be part of computing device 500.

Computing device 500 can also include an interface bus 542 for facilitating communication from various interface devices (e.g., output interfaces, peripheral interfaces, communication interfaces, etc.) to the basic configuration 501 via the bus/interface controller 540. Example output devices 560 include a graphics processing unit 561 and an audio processing unit 562, either or both of which can be configured to communicate to various external devices such as a display or speakers via one or more A/V ports 563. Example peripheral interfaces 570 include a serial interface controller 571 or a parallel interface controller 572, which can be configured to communicate with external devices such as input devices (e.g., keyboard, mouse, pen, voice input device, touch input device, etc.) or other peripheral devices (e.g., printer, scanner, etc.) via one or more I/O ports 573.

An example communication device 580 includes a network controller 581, which can be arranged to facilitate communications with one or more other computing devices 590 over a network communication (not shown) via one or more communication ports 582. The communication connection is one example of a communication media. Communication media may typically be embodied by computer readable instructions, data structures, program modules, or other data in a modulated data signal, such as a carrier wave or other transport mechanism, and includes any information delivery media. A "modulated data signal" can be a signal that has one or more of its characteristics set or changed in such a manner as to encode information in the signal. By way of example, and not limitation, communication media can include wired media such as a wired network or directwired connection, and wireless media such as acoustic, radio frequency (RF), infrared (IR) and other wireless media. The term computer readable media as used herein can include both storage media and communication media.

Computing device 500 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 500 can also be implemented as a personal computer including both laptop computer and non-laptop computer configurations.

There is little distinction left between hardware and software implementations of aspects of systems; the use of hardware or software is generally (but not always, in that in certain contexts the choice between hardware and software can become significant) a design choice representing cost versus efficiency trade-offs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation. In one or more other scenarios, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those skilled within the art that each function and/or operation within such block diagrams, flowcharts, or examples can be implemented, individually and/or collectively, by a wide range of hardware, software, firmware, or virtually any combination thereof.

In one or more embodiments, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments described herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof. Those skilled in the art will further recognize that designing the circuitry and/or writing the code for the software and/or firmware would be well within the skill of one of skilled in the art in light of the present disclosure.

Additionally, those skilled in the art will appreciate that the mechanisms of the subject matter described herein are capable of being distributed as a program product in a variety of forms, and that an illustrative embodiment of the subject matter described herein applies regardless of the particular type of signal-bearing medium used to actually carry out the distribution. Examples of a signal-bearing medium include, but are not limited to, the following: a recordable-type medium such as a floppy disk, a hard disk drive, a Compact Disc (CD), a Digital Video Disk (DVD), a digital tape, a computer memory, etc.; and a transmission-type medium such as a digital and/or an analog communication medium (e.g., a fiber optic cable, a waveguide, a wired communications link, a wireless communication link, etc.).

Those skilled in the art will also recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A method performed by a teleconference computing device for suppressing transient noise in an audio signal, the method comprising:

extracting one or more voiced parts from an audio signal input from an audio capture device to yield a residual part of the audio signal;

decomposing the residual part of the signal into a sparse set of coefficients corresponding to noise pulses in the residual part of the signal;

modeling each of the coefficients as a switched noise pulse combined with additive noise;

estimating initial probabilities of detection states for each of the modeled coefficients;

calculating transition probabilities between each of the detection states;

determining a probable detection state for each of the coefficients based on the initial probabilities of the detection states for each of the coefficients, the calculated transition probabilities between each of the detection states, and observation probabilities determined from observed data associated with the noise pulses;

filtering out transient noise from the residual part of the signal based on the probable detection states determined for the coefficients; and combining the filtered residual part of the signal with the one or more extracted voiced parts of the signal, wherein the transient noise is at least one of feedback noise, fan noise, and button-clicking noise due to mechanical connection between the audio capture device and a keyboard or trackpad of the teleconferencing computing device.

2. The method of claim 1, wherein extracting the one or more voiced parts of the audio signal includes recursively subtracting tonal components from the audio signal.

3. The method of claim 1, wherein the residual part of the signal is decomposed into a sparse set of coefficients using a wavelet packet transform.

4. The method of claim 1, wherein estimating the initial probability of the one or more detection states for each of the coefficients includes modeling the switched noise pulse and the additive noise as zero-mean Gaussian distributions.

5. The method of claim 4, wherein the switched noise pulse is modeled using a changing variance model based on an envelope of the changing variance of the noise pulse.

6. The method of claim 1, wherein estimating the initial probability of the one or more detection states for each of the coefficients includes modeling the additive noise using an autoregressive (AR) model with estimated parameters.

7. The method of claim 1, wherein the probable detection states for the coefficients are determined using a Hidden Markov Model (HMM).

8. The method of claim 1, further comprising determining, based on the combined residual part and the one or more extracted voiced parts, whether to perform further transient noise suppression on the audio signal.

9. The method of claim 1, further comprising, prior to combining the filtered residual part of the signal and the one or more extracted voiced parts of the signal:

determining that the one or more extracted voiced parts include low-frequency components of transient noise; and filtering out the low-frequency components of transient noise from the one or more extracted voiced parts.

10. The method of claim 1, further comprising identifying the one or more voiced parts of the audio signal by detecting spectral peaks in the frequency domain of the audio signal.

11. The method of claim 10, wherein the spectral peaks are detected by thresholding a median filter output.

12. The method of claim 1, further comprising performing the extraction of voiced parts of the audio signal multiple times using different frame sizes.

13. The method of claim 1, further comprising performing the extraction of voiced parts of the audio signal multiple times using different thresholds for a median filter output.

14. The method of claim 1, wherein filtering out transient noise from the residual part of the audio signal includes:

identifying corrupted samples of the residual part of the audio signal based on the probable detection states determined for the coefficients; and removing the corrupted samples from the audio signal.

15. The method of claim 14, further comprising restoring the corrupted samples removed from the audio signal.

16. The method of claim 1, further comprising:

determining, based on the residual part of the audio signal, that additional voiced parts remain in the residual part of the audio signal; and extracting one or more of the additional voiced parts from the residual part of the audio signal.

17. The method of claim 1, wherein the noise pulses in the residual part of the audio signal correspond to mechanical impulses caused by keystrokes on a keypad.

18. A teleconferencing computing system for suppressing transient noise in an audio signal, the system comprising:

at least one processor; and a non-transitory computer-readable medium coupled to the at least one processor having instructions stored thereon that, when executed by the at least one processor, causes the at least one processor to:

extract one or more voiced parts from an audio signal input from an audio capture device to yield a residual part of the audio signal;

decompose the residual part of the signal into a sparse set of coefficients corresponding to noise pulses in the residual part of the signal;

model each of the coefficients as a switched noise pulse combined with additive noise;

estimate initial probabilities of detection states for each of the modeled coefficients;

calculate transition probabilities between each of the detection states;

determine a probable detection state for each of the coefficients based on the initial probabilities of the detection states for each of the coefficients, the calculated transition probabilities between each of the detection states, and observation probabilities determined from observed data associated with the noise pulses;

filter out transient noise from the residual part of the signal based on the probable detection states determined for the coefficients; and combine the filtered residual part of the signal with the one or more extracted voiced parts of the signal, wherein the transient noise is at least one of feedback noise, fan noise, and button-clicking noise due to mechanical connection between the audio capture device and a keyboard or trackpad of the teleconferencing computing system.

19. The system of claim 18, wherein the at least one processor is further caused to:

prior to combining the filtered residual part of the signal and the one or more extracted voiced parts of the signal, determine that the one or more extracted voiced parts include low-frequency components of transient noise; and filter out the low-frequency components of transient noise from the one or more extracted voiced parts.

20. The system of claim 18, wherein the probable detection states for the coefficients are determined using a Hidden Markov Model (HMM).

* * * * *